US006564492B2

(12) United States Patent
Weldle et al.

(10) Patent No.: US 6,564,492 B2
(45) Date of Patent: May 20, 2003

(54) RETRACTABLE SHOULDER STOCK

(75) Inventors: Helmut Weldle, Oberndorf (DE); Gerd Spinner, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 10/046,862

(22) Filed: Jan. 15, 2002

(65) Prior Publication Data

US 2002/0059747 A1 May 23, 2002

Related U.S. Application Data

(63) Continuation of application No. PCT/EP00/06895, filed on Jul. 19, 2000.

(30) Foreign Application Priority Data

Jul. 30, 1999 (DE) ..... 199 35 928

(51) Int. Cl.[7] ..... F41C 23/08
(52) U.S. Cl. ..... 42/74; 42/73
(58) Field of Search ..... 42/71.01, 73, 74

(56) References Cited

U.S. PATENT DOCUMENTS

| | | | | | |
|---|---|---|---|---|---|
| 524,458 | A | * | 8/1894 | Blake | |
| 2,424,194 | A | * | 7/1947 | Sampson et al. | 42/72 |
| 2,787,855 | A | * | 4/1957 | Guymon | 42/73 |
| 3,137,958 | A | | 6/1964 | Lewis et al. | 42/73 |
| 3,442,042 | A | * | 5/1969 | Gilbert | 42/73 |
| 3,570,162 | A | | 3/1971 | Suddarth | 42/72 |
| 3,795,998 | A | * | 3/1974 | Kuhl | 42/74 |
| 4,383,384 | A | | 5/1983 | Fox | 42/72 |
| 4,663,877 | A | * | 5/1987 | Bragg | 42/74 |
| 4,769,937 | A | * | 9/1988 | Gregory et al. | 42/74 |
| 5,367,812 | A | | 11/1994 | Lautrec | 42/74 |

FOREIGN PATENT DOCUMENTS

| | | | | |
|---|---|---|---|---|
| BE | 513 551 | * | 4/1954 | 42/71.01 |
| CH | 126 420 | * | 7/1928 | 42/74 |
| DE | 1 225 517 | | 9/1966 | |
| DE | G 88 07 539 U1 | | 11/1989 | |
| FR | 1.536.354 | * | 8/1968 | 42/71.01 |

OTHER PUBLICATIONS

*International Search Report*, corresponding to International Patent Application Ser. No. PCT/EP00/06895, European Patent Office, dated Nov. 10, 2000, 3 pages.

*International Preliminary Examination Report*, corresponding to International Patent Application Ser. No. PCT/EP00/06895, European Patent Office dated Feb. 20, 2001, 4 pages.

English–Language Translation of the *International Preliminary Examination Report* corresponding to International Patent Application Ser. No. PCT/EP00/06895, European Patent Office, Dated Mar. 11, 2002, 5 pages.

* cited by examiner

*Primary Examiner*—Stephen M. Johnson
(74) *Attorney, Agent, or Firm*—Grossman & Flight, LLC

(57) ABSTRACT

Apparatus and methods are disclosed for releasably securing a retractable shoulder stock relative to the casing of a firearm. The retractable shoulder stock includes a slide rail which is displaceable relative to the casing. The slide rail defines a recess. The shoulder stock also includes a catch lever which is mounted for rotation about an axis. The catch lever has a peripheral surface that can be manually engaged to rotate the catch lever about the axis. The catch lever is positioned to selectively engage in the recess to releasably lock the slide rail in a first predetermined position.

29 Claims, 2 Drawing Sheets

RETRACTABLE SHOULDER STOCK

RELATED APPLICATION

This patent is a continuing application which claims priority under 35 U.S.C. §120 from International Application Serial No. PCT/EP00/06895, filed Jul. 19, 2000.

FIELD OF THE INVENTION

The invention relates generally to firearms, and, more particularly, to a retractable shoulder stock for a firearm and a catch lever for such a shoulder stock.

BACKGROUND OF THE INVENTION

The terms used in this document to describe relative position, such as "forward," "top," "left" and so forth are referenced to a weapon which is properly positioned to deliver a horizontal shot, with the direction of shooting being toward the front (i.e., away from the shooter). The same convention also applies to the corresponding directional references ("toward the front," "toward the top," "to the left," and so forth).

Automatic guns or machine guns often have an extendable shoulder stock which is mounted on guide rods and which can be secured by means of a catch mechanism. In U.S. Pat. No. 3,570,162, for example, the shoulder stock is mounted on a rod which is guided in a pipe so that it can be displaced longitudinally. A retaining claw passes through the pipe wall and engages in a corresponding catch notch of the rod so that the shoulder stock can be secured in the inserted and extracted positions. U.S. Pat. No. 4,383,384 also discloses an extendable shoulder stock. That shoulder stock is guided by two parallel rods, one of which can be locked by a catch pin which engages in corresponding recesses in the rod.

In addition, U.S. Pat. No. 3,137,958 describes an adjustable shoulder stock which is guided by two parallel extractable rods. The rods have catch notches. A catch body that is displaceable across the rods is engaged in the catch notches, thereby securing the position of the shoulder stock. U.S. Pat. No. 5,367,812 discloses another adjusting mechanism, where the rods mounted on the shoulder stock can be extended by means of screw-on elements.

Finally, German Utility Model 88 07 539 U1 discloses a shoulder stock with a receiving pipe in which a supporting rod or a supporting pipe can be telescoped and locked in position. The supporting rod or pipe is locked by locking screws which engage in the supporting rod or supporting pipe when in the desired position.

These known arrangements have the disadvantage that there is a certain play in the shoulder stock even in the locked state. This play has a negative effect on the stability of the gun, which stability is necessary to deliver a well-aimed shot.

A much better solution has been found to be the shoulder stock known from German Patent 1,225,517 by the owner of the present patent. The stock disclosed in that patent is mounted on slide rails which can be locked at the end of the gun casing by a locking element that is mounted so it can rotate. Locking projections of this element engage in corresponding recesses on the slide rail, preferably in such a way that they are put under tension in the radial direction to the axis of rotation of the locking element. Due to this tension, the shoulder stock has an increased stability in the locked state comparable to that of a one-piece rigid gun butt.

In a preferred implementation of the shoulder stock of German Patent 1,225,517, the locking element is designed as a ring-shaped base body and is mounted on a sleeve-shaped casing in the interior of the gun casing. The locking element is, thus, engaged with an operating ring which is used to operate the locking element. The operating ring is provided with an operating wing and is mounted outside the gun casing. This design is characterized by a great robustness and reliability and has proven successful in long-term use (e.g., in the case of the G3 gun of the Deutsche Bundeswehr [German military]). In particular, the shoulder stock is also capable of absorbing high forces, such as that required when firing shells or grenades, for example.

However, the design also includes disadvantages. For example, this design is relatively heavy and takes up a lot of space due to the massive cylinder-shaped construction. It, therefore, seems overdimensioned for certain applications (e.g., for light machine guns or other weapons that do not have such high stability requirements).

SUMMARY OF THE INVENTION

In accordance with an aspect of the invention, a retractable shoulder stock is provided for use with a firearm having a casing . The retractable shoulder stock includes a slide rail which is displaceable relative to the casing of the firearm. The slide rail defines at least one recess. The shoulder stock also includes a catch lever which is mounted for rotation about an axis. The catch lever has a peripheral surface that can be manually engaged to rotate the catch lever about the axis. The catch lever is positioned to selectively engage in the at least one recess to releasably lock the slide rail in a first predetermined position.

In accordance with another aspect of the invention, a method of releasably securing a retractable stock of a firearm in a first predetermined position is provided. The method includes the steps of: pivoting a catch lever to disengage the catch lever from a first recess defined in a slide rail associated with the retractable stock; moving the slide rail; and pivoting the catch lever to engage a second recess defined in the slide rail.

Other features and advantages are inherent in the disclosed apparatus or will become apparent to those skilled in the art from the following detailed description and its accompanying drawings.

DESCRIPTION OF THE PREFERRED EMBODIMENTS

Figures 1, 2:
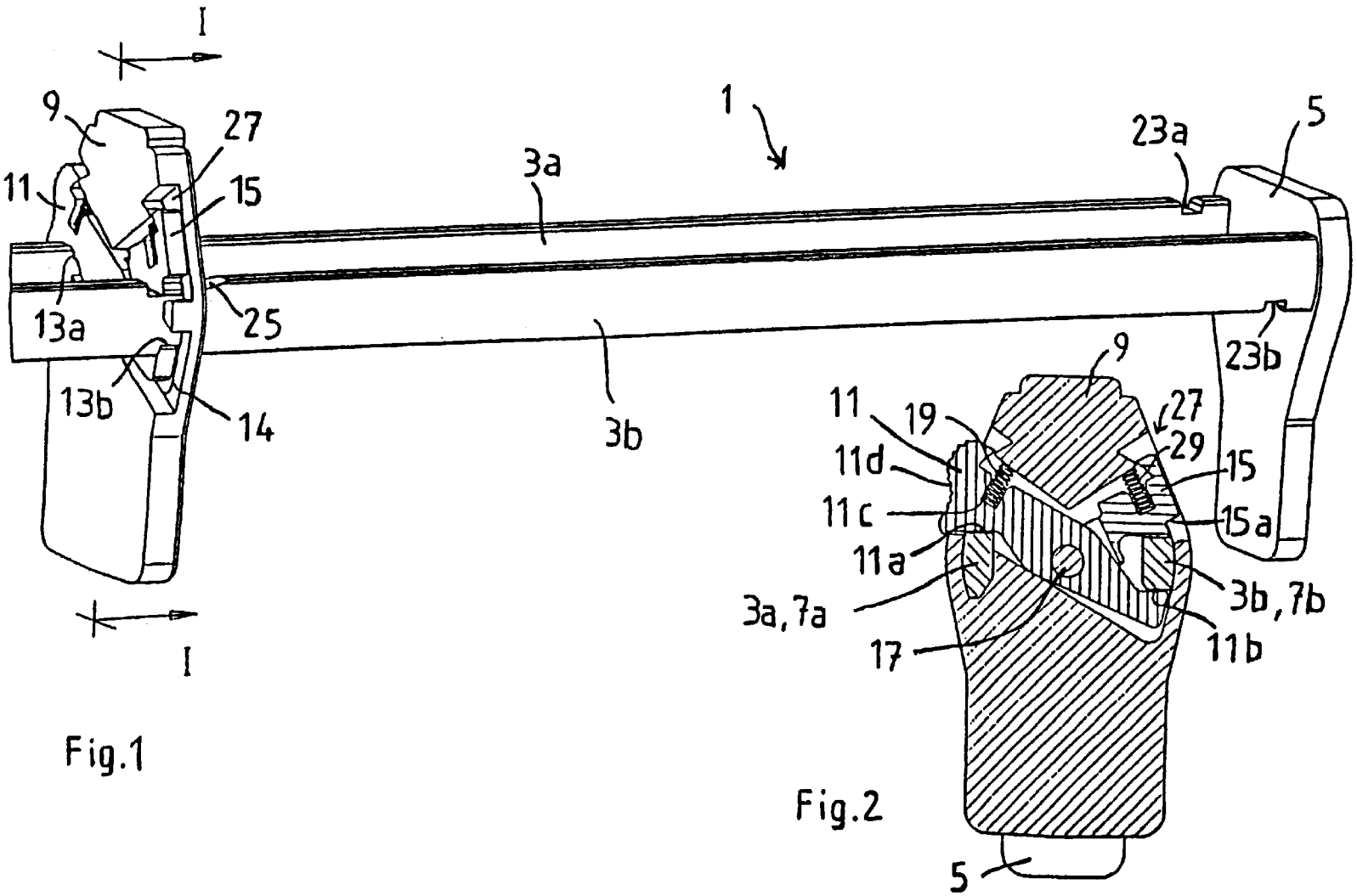
FIG. 1 is a an inclined, left side view of a first exemplary shoulder stock constructed in accordance with the teachings of the invention.
FIG. 2 is a front, sectional view taken along lines I—I of FIG. 1.

FIG. 1 shows a shoulder stock 1 of a machine gun. The stock 1 has two slide rails 3*a* and 3*b* having rear ends mounted on a shoulder cap 5. The cap 5 connects the two slide rails 3*a*, 3*b* to one another. The two slide rails 3*a*, 3*b* pass through suitably designed openings 7*a* and 7*b* in an end plate 9 of the gun casing. The slide rails 3*a*, 3*b* are mounted so they can be displaced in the longitudinal direction of the gun through the openings 7*a*, 7*b* as well as through other guides (not shown) on the gun casing. A catch lever 11 is integrated into the end plate 9. The catch lever 11 simultaneously engages in recesses 13*a*, 13*b* in the slide rails 3*a*, 3*b*, so that the rails 13*a*, 13*b* are locked to prevent displacement. To visualize engagement of the catch lever 11 in the recess 13*b*, the end plate 9 is shown in FIG. 1 with a cutout at 14. The shoulder stock 1 is secured in this way in the use position shown here. In this position, the slide rails 3*a*, 3*b* project approx. 200 mm out of the end plate toward the rear. The front portions of the slide rails 3*a*, 3*b* which are then still mounted in the gun casing have a sufficient length (approx. 100 mm) to be securely supported in the gun casing. This imparts additional stability to the shoulder stock 1 in the use position. The slide rails 3*a*, 3*b* have additional recesses 23*a*, 23*b* on their rear ends, close to the shoulder cap 5, serving to secure the shoulder stock in the retracted position (i.e., in the resting position), in a similar manner (i.e., by engagement with the lever 11).

Furthermore, a securing lever 15 is integrated into the end plate 9. The securing lever 15 engages in a recess 25 on the slide rail 3*b*; its function is described in greater detail below.

FIG. 2 shows a cross sectional view taken along line I—I through the end plate 9. The catch lever 11 is mounted without play on a pin 17 so it can rotate. The pin is mounted on the end plate 9, with its central axis being the axis of rotation of the catch lever 11. The pin 17 is located exactly between the two slide rails 3*a*, 3*b*, so that the axis of rotation of the catch lever 11 is arranged concentrically with the slide rails 3*a*, 3*b*. The catch lever 11 has flat areas 11*a* and 11*b* with which it rests on the top side of the slide rail 3*a* and on the bottom side of slide rail 3*b*, respectively. The catch lever 11 is loaded by a spring 19. The spring 19 is mounted with one end in a blind hole 11*c* located in the catch lever 11. The spring 19 is supported at its other end against the end plate 9. Due to the force of the spring 19, a counterclockwise torque acts on the catch lever 11, so that the slide rails 3*a*, 3*b* are in turn pressed down and up, respectively, by the catch lever 11. The slide rails 3*a*, 3*b* are in this way put under tension toward one another and against their guides in the gun casing. The play in the slide rails 3*a*, 3*b* is, thus, reduced and the stability of the shoulder stock 1 is increased.

The recesses 13*a*, 13*b*, 23*a*, 23*b* are designed as grooves running across the longitudinal direction of the gun, passing through the respective slide rails 3*a*, 3*b* in their width. The slide rails 3*a*, 3*b* each have a substantially rectangular cross section which is curved slightly outward on the outer side. This shape enhances the torsional rigidity of the shoulder stock 1 and at the same time takes up little space in terms of width. The flat areas 11*a*, 11*b* of the catch lever 11 rest on the slide rails 3*a*, 3*b* over their entire width. The catch lever 11 is, thus, securely in contact with the slide rails 3*a*, 3*b* in their displacement. Therefore, no longitudinal grooves or the like for guiding the catch lever 11 are necessary on the slide rails 3*a*, 3*b*. Thus, the slide rails can be manufactured more easily and less expensively.

In the diagram shown here, the shoulder stock 1 is secured in the use position. Specifically, the catch lever 11 engages in the recesses 13*a*, 13*b* on the slide rails 3*a*, 3*b*. To release the lock, the catch lever 11 is turned clockwise against the force of the spring 19 to remove it from recesses 13*a*, 13*b*. The slide rails 3*a*, 3*b* can then be pushed into the gun casing to insert the shoulder stock 1. If the catch lever 11 is released during the insertion of the shoulder stock 1, it rests on the on the top side of slide rail 3*a* and/or on the bottom side of slide rail 3*b* due to the force of the spring 19 until it automatically engages in the two recesses 23*a*, 23*b* with further insertion of the slide rails 3*a*, 3*b*. The shoulder stock 1 is then secured in its resting position in which the shoulder cap 5 is at a slight distance from the end plate 9.

To make it easier for the marksman to grip the catch lever 11, the catch lever 11 is lengthened on the side of the slide rail 3*a*, in such a way that its outer periphery projects out of the end plate 9 of the gun casing on this side to form a handle 11*d*. The outer periphery, thus, extends beyond the outer ends of the recesses 13*a*, 13*b* (and the gun casing as well) at this point. The handle 11*d* has a trough-shaped recess and a grooved surface (see FIG. 2), so that the catch lever 11 can be gripped easily there and operated by the marksman's finger.

FIG. 2 shows that the handle 11*d* and the contact surfaces 11*a*, 11*b*, are integrated into one part, namely the catch lever 11. Consequently, no intermediate elements or the like are necessary. The design of the shoulder stock 1 is thus greatly simplified in comparison with the known solutions, thereby, saving on space and weight. Therefore, the shoulder stock of FIG. 1 has by a very compact and lightweight design which makes it especially suitable for machine guns and light machine guns. Thus, the shoulder stock 1 illustrated in FIGS. 1 and 2 is intended for use in a machine gun whose total weight is approx. 1.5 kg, but other types of guns and guns with different weights could also benefit from the use of this stock.

The securing lever 15 is mounted without play on the pin 17 so it can rotate in a manner like that used with the catch lever 11. The securing lever 15 is placed under load in the clockwise direction of rotation (see FIG. 2) by a spring 29. Due to the force of the spring 29, the securing lever 15 rests on the top side of the slide rail 3*b* and engages in the recess 25 in the position illustrated here. Recess 25 passes like a groove through the slide rail 3*b* in the transverse direction, running upward on its rear side in the form of an inclined face as shown in FIG. 1. Therefore, the securing lever 15 easily slides out of recess 25 without further manipulation when the slide rail 3*b* is inserted. This ensures that the securing lever 15 does not interfere with the insertion of the shoulder stock 1. The function of the securing lever 15 is that the marksman cannot unintentionally pull the shoulder stock 1 completely out. This could otherwise happen if the marksman would hold the catch lever 11 upward under pressure while pulling the shoulder stock 1 out. Then the catch lever 11 cannot engage in the recesses 13*a*, 13*b*, so, absent the securing lever 15, the slide rails 3*a*, 3*b* could slide completely out of their guides in the gun casing. However, the securing lever 15 prevents the shoulder stock 1 from being extracted completely in that it automatically engages in the recess 25 under the load of the spring 29. The slide rail 3*b* is then locked to prevent it from being displaced in the direction of extraction, and the shoulder stock 1 is secured to prevent further extraction.

For the case when the marksman would like to intentionally remove the shoulder stock, he can release the lock by means of the securing lever 15. To do so, he must push the securing lever 15 upward, like the catch lever 11, against the force of the spring 29 to such an extent that it no longer engages in the recess 25. To be able to completely pull out the shoulder stock 1 to remove it, the marksman must also release the lock on the slide rail 3*a* by the catch lever 11 in the manner described above.

Unlike the catch lever 11, the securing lever 15 does not project out of the gun casing, so that the marksman cannot grip it by hand. Although the securing lever 15 is accessible from the outside through a slot-like opening 27 in the end plate 9, this opening 27 is preferably too narrow to allow the marksman to reach in it with his fingers. This prevents accidental release of the securing lever 15. Nevertheless, it is easy to intentionally release the securing lever 15 because the marksman can press it upward by using any pointed tool. The point of action for that is a notch-like recess 15*a* on the lower side of the securing lever 15 (see FIG. 2).

Figure 3:
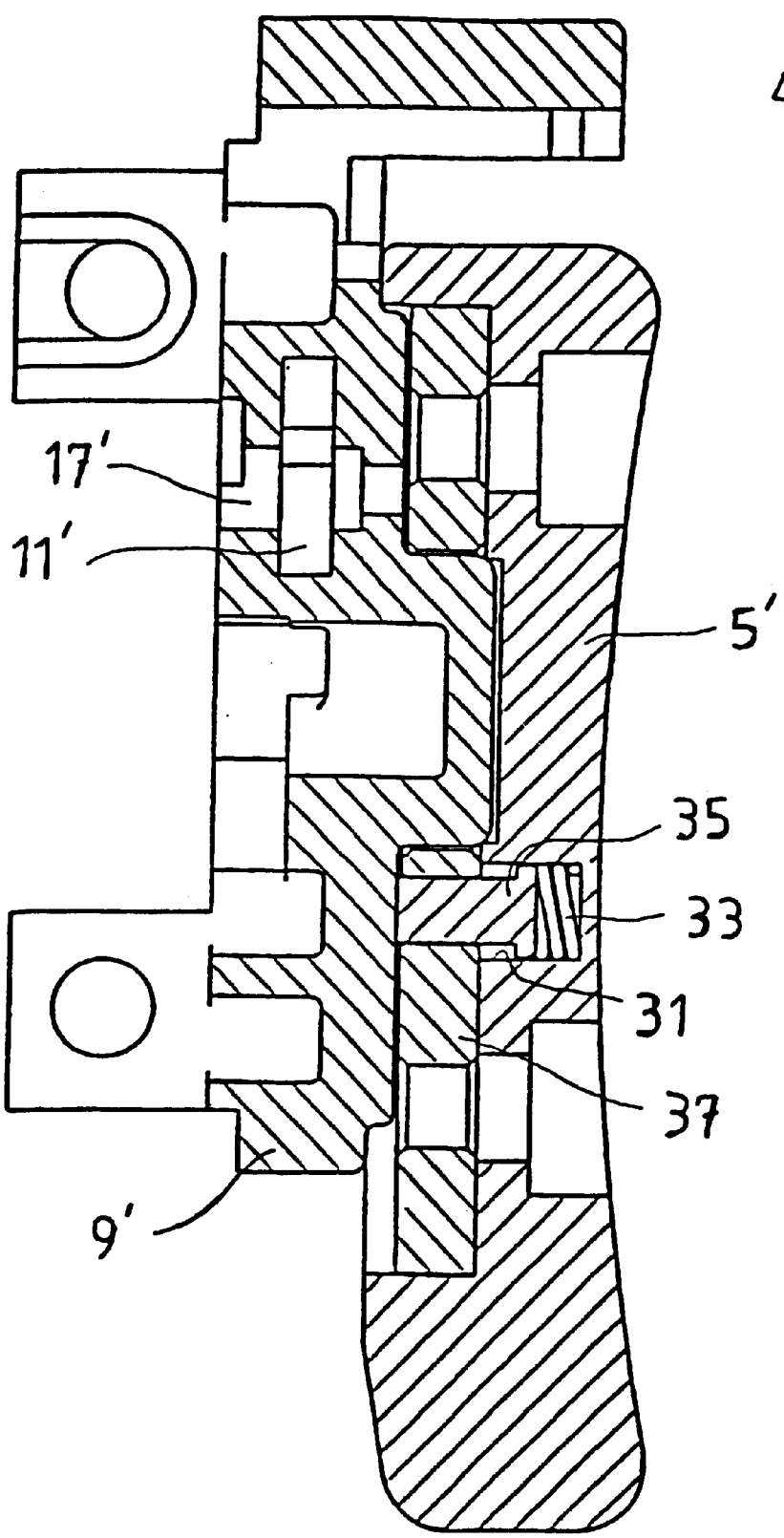
FIG. 3 is a partial sectional view of a second exemplary shoulder stock constructed in accordance with the teachings of the invention.

FIG. 3 shows a partial, sectional diagram of another shoulder stock 1' constructed in accordance with the teachings of the invention and shown in the resting position. The shoulder stock 1' is secured in this resting position by a catch lever 11' which is rotatably mounted on a pin 17'. The design and functioning of this shoulder stock 1' correspond largely to that of shoulder stock 1 described above. Therefore, parts having the same function are provided with the same reference notation, but with apostrophes added for the purpose of differentiating them.

The primary difference between shoulder stocks 1 and 1' is that the shoulder cap 5' of the shoulder stock 1' has a blind hole 31. A spring 33 is mounted in the blind hole 31. The spring 33 is supported against a pin 35. The pin 35, which is displaceably mounted in the blind hole 31, has on its rear end a shoulder. The front end passes from the pin 35 through an intermediate plate 37 which is mounted on the shoulder cap 5'. In the resting position of the shoulder stock 1' shown here, the spring 33 is compressed so that it exerts a force on the end plate 9' (or the shoulder cap 5') by way of the pin 35. This force tends to move the shoulder stock 1' to the right in FIG. 3 out of its resting position. If the safety on the shoulder stock 1' is lifted by operating the catch lever 11' (as is the case with the shoulder stock 1), the spring 33 presses the shoulder cap 5' and intermediate plate 37 downward over the pin 35. The shoulder stock 1' is, thus, automatically moved out of its resting position by the spring 33 upon operation of the catch lever 11'. When so released, the rear shoulder runs toward and into engagement with the intermediate plate 37. With the shoulder stock 1' shown here, this corresponds to a distance of approx. 2 mm.

This automatic movement of the shoulder stock 1' out of its resting position has the advantage that the marksman need not pull the shoulder cap 5' downward at the same time when releasing the catch lever 11'. One-handed operation of the shoulder stock 1' is, thus, readily possible in this way. In addition, this prevents the marksman from making operation of the catch lever 11' more difficult for himself due to excessive pulling on the shoulder cap 5'.

It would be possible to design the locking element of the shoulder stock described in German Patent 1,225,517 to be smaller, and to make it lighter and more space-saving due to the altered proportions. Additional weight could also be saved by using lighter materials.

However, the shoulder stocks 1, 1' disclosed herein pursue a different option. The locking element 11 illustrated in this patent can be gripped directly by the hand from the outside and turned, in particular even when mounted in the interior of the gun casing. Intermediate elements such as the operating ring mentioned in the background section above are, thus, eliminated. The axis of rotation of the locking element 11 is preferably arranged in the longitudinal direction of the handgun.

Persons of ordinary skill in the art will appreciate that the illustrated shoulder stocks 1, 1' have (a) at least one slide rail 3*a*, 3*b* which is displaceable together with the shoulder stock 1, 1' relative to the gun casing; and (b) at least one catch lever 11, 11' which is mounted to rotate about the longitudinal axis of the handgun and which can be directly manually engaged over its outer periphery. The slide rail is lockable by means of the catch lever 11, 11' in that the catch lever 11, 11' engages in a corresponding recess 13*a*, 13*b*, 23*a*, 23*b* on the slide rail 3*a*, 3*b* thereby securing the shoulder stock in the corresponding position.

The term "slide rail" as used here is intended to refer to any type of guide element suitable for displaceably connecting the shoulder stock 1, 1' to the gun casing. It is preferably a tubular or rod-shaped body having any desired cross-sectional shape which is displaceably mounted in a corresponding recess or indentation on the gun casing. Due to the displaceability of the slide rail 3*a*, 3*b* within its guide in or on the gun casing, the shoulder stock can be pushed in or pulled out. "Manually operable" in this context means that the catch lever 11, 11' can be rotated by hand (preferably without the use of a tool), in such a way that the slide rail 3*a*, 3*b* can thereby be selectively locked to prevent its displacement or released to make it displaceable again. By locking the slide rail to prevent its displacement, the shoulder stock 1, 1' attached thereto is secured in the corresponding position.

The catch lever 11, 11' can be operated by its outer periphery. The outer periphery is referenced to the axis of rotation of the catch lever 11, 11' and represents its periphery. It is not necessary for the catch lever 11, 11' to be grippable on its entire outer periphery but, instead, it is preferable that only a portion of it is gripped for turning the lever 11, 11'. The catch lever 11, 11' is operated directly by way of the outer periphery (i.e., it can be directly engaged and the engaged surface is secured to the catch lever 11, 11' which engages in the recess 13*a*, 13*b*, 23*a*, 23*b* in the slide rail 3*a*, 3*b*).

The slide rail 3*a*, 3*b* is locked to prevent its displacement in that the catch lever 11, 11' engages in a corresponding recess 13*a*, 13*b*, 23*a*, 23*b* on the slide rail 3*a*, 3*b* through its rotational movement. The axis of rotation of the catch lever 11, 11' preferably extends in the longitudinal direction of the handgun, so that the catch lever 11, 11' is mounted to rotate across the longitudinal direction of the gun. Depending on the geometry of the gun, however, it may also be advantageous to arrange the axis of rotation in a different direction.

Preferably, the catch lever 11, 11' is spring loaded in the direction of rotation intended for locking so that it is in contact with the slide rail 3*a*, 3*b* under pressure. Handling of the shoulder stock 1, 1' is simple in this case because the catch lever 11, 11' need be only operated manually to release the lock, while locking the slide rail 3*a*, 3*b* again takes place automatically due to the load of the spring 19. The catch lever 11, 11' engages automatically in a recess 13*a*, 13*b*, 23*a*, 23*b* when it passes over it.

The catch lever 11, 11' and the recesses 13*a*, 13*b*, 23*a*, 23*b* in the slide rail 3*a*, 3*b* may have any desired design. Preferably, the catch lever 11, 11' is a counterpart to the recesses 13*a*, 13*b*, 23*a*, 23*b* suitable for locking the slide rail 3*a*, 3*b*. The recesses 13*a*, 13*b*, 23*a*, 23*b* are preferably designed so that it passes through the slide rail 3*a*, 3*b* in the transverse direction of the handgun. This is advantageous for the case when the catch lever 11, 11' is mounted to rotate across the longitudinal direction of the gun, as described above. The catch lever 11 11' can then engage in the recess 13*a*, 13*b*, 23*a*, 23*b* so that it is in contact with the slide rail 3*a*, 3*b* over its entire width. In a preferred embodiment, the catch lever is mounted in the radial direction to its axis of rotation so that its outer periphery extends beyond the end of the recess in this direction. The lengthened part of the outer periphery then projects laterally over the slide rail 3*a*, 3*b* and presents a good contact surface for manual operation by the marksman. If necessary, the outer periphery may also be lengthened to the extent that it projects laterally out of the gun casing.

For the easiest possible operation of the catch lever 11, 11', it is advantageous, regardless of the alignment of its axis of rotation, if the catch lever 11, 11' has a handle, such as a trough-like recess or a nose-shaped projection to be gripped by the marksman. Therefore, the outer periphery of the catch lever 11, 11' preferably forms such a handle 11*d* in at least one area.

When the gun is not in use or is being transported, it is advantageous if the shoulder stock 1, 1' can be inserted as far as the end plate 9 of the gun casing, preferably in such a way that plates 5 and 9 are in contact with one another. This position is referred to herein as the "resting position." To use the gun, the shoulder stock 1, 1' is pulled out of its resting position and into a position in which shooting is possible, with the weapon resting on the shoulder for taking aim (referred to herein as the "use position"). With many guns, it is sufficient to provide for one resting position and one use position. However, it may also be expedient to provide multiple use positions (e.g., to take into account different arm lengths of different marksmen). Then additional recesses are provided on the slide rail 3*a*, 3*b* at corresponding locations to secure the shoulder stock 1, 1' in the various use positions. The shoulder stock 1, 1' can, thus, be adjusted to different lengths.

The slide rail 3*a*, 3*b* thus preferably has at least two recesses such that the shoulder stock can be secured in one resting position and in at least one use position. The shoulder stock 1' is preferably spring loaded in its resting position, with the spring 33 attempting to push the shoulder stock 1' out of its resting position in the direction of the at least of one use position. This causes the shoulder stock 1' to move automatically out of its resting position as soon as the lock on the slide rail 3*a*, 3*b* has been cancelled by appropriate operation of the catch lever 11'. In this way, it is easier for the marksman to pull out the shoulder stock 1', because then he need not pull on the shoulder stock 1' at the same time as he is operating the catch lever 11'.

Starting from a simple design of the shoulder stock 1, 1' with a slide rail 3*a* and a catch lever 11, 11', the shoulder stock 1, 1' can be refined further, depending on the intended purpose. An arrangement with two slide rails 3*a*, 3*b*, both of which can be locked by a single catch lever 11, has proven especially advantageous. Through this arrangement, it is readily possible to unlock the shoulder stock 1, 1' with one hand. The axis of rotation of the catch lever 11, 11' is preferably arranged between the two slide rails 3*a*, 3*b*, preferably in the longitudinal direction of the gun, with the catch lever 11, 11' being designed so that it is In contact with the top side of the first slide rail 3*a* and at the same time is in contact with the bottom side of the second slide rail 3*b*. For locking the two slide rails 3*a*, 3*b*, the catch lever 11, 11' then engages in corresponding recesses 13*a*, 13*b*, 23*a*, 23*b* on the top and bottom sides of the slide rails 3*a*, 3*b*. In this crossed arrangement, the catch lever 11, 11' is preferably spring loaded, so that the slide rails 3*a*, 3*b* are under tension toward one another and toward their guide in the gun casing. The stability of the shoulder stock 1, 1' is therefore enhanced, so that it is possible to deliver a well-aimed shot. In addition, the shoulder stock 1, 1' is then spring loaded on two sides, namely at the top and bottom. This reduces the risk that the shoulder stock 1, 1' might be knocked out of its locked position due to strikes or impacts (e.g., when the marksman is moving over impassable terrain).

In the crossed arrangement, the catch lever 11, 11' and/or the recesses 13*a*, 13*b*, 23*a*, 23*b* are preferably designed so that the slide rails 3*a*, 3*b* are under tension in the radial direction to the axis of rotation of the catch lever 11, 11' when the catch lever 11, 11' engages in the recesses 13*a*, 13*b*, 23*a*, 23*b*. This further increases the stability of the shoulder stock 1, 1' and can be achieved, for example, by the fact that the recesses 13*a*, 13*b*, 23*a*, 23*b* have inclined faces against which the spring-loaded catch lever 11, 11' presses. Depending on whether the inclined faces are located on the inside or outside of the slide rails 3*a*, 3*b*, they are then pressed in the direction toward one another or apart from one another.

As described previously, the shoulder stock 1, 1' is released manually by the marksman when he turns the catch lever 11, 11' so that it no longer engages in the corresponding recess(es) 13*a*, 13*b*, 23*a*, 23*b* in the slide rail(s) 3*a*, 3*b*. The shoulder stock 1, 1' can then be shifted. If the stock 1, 1' holds the catch lever 11, 11' in its twisted (i.e., disengaged) position, it cannot engage in the next recess(es) 13*a*, 13*b*, 23*a*, 23*b* (even if it is spring loaded). In this way, it may happen under some circumstances that the marksman unintentionally pulls the shoulder stock 1, 1' completely out of its guide in the gun casing. This may be prevented, for example, by an elevated shoulder on the end of the slide rail 3*a*, 3*b* against which the catch lever 11, 11' strikes even in its twisted (i.e., disengaged) position. However, a spring-loaded safety element 15 is provided as the preferred antidote here. This safety element 15 automatically engages in a recess 25 in the slide rail 3*b* which is provided for this purpose when the shoulder stock 1, 1' is pulled out. The shoulder stock 1, 1' is, thus, secured in its extreme withdrawn position in the same way or at least almost in the same way as it is by the catch lever 11, 11', and it cannot be pulled out further. If necessary, the safety element 15 may be designed so that it engages in multiple recesses on one or more slide rails 3*a*, 3*b* at the same time.

The safety element 15 limits the displacement of the shoulder stock 1, 1' preferably to its outer use position (i.e., in the use position in which the shoulder stock is pulled out to the maximum extent). The marksman can then additionally secure the shoulder stock 1, 1' by means of the catch lever 11, 11' by turning it back into the engaged position or by simply releasing the catch lever 11, 11' if it is spring-loaded. To simplify the renewed insertion of the shoulder stock 1, 1' as much as possible, it is advantageous if the safety element 15 need not be released for this purpose. The safety element 15 and/or the respective recess(es) 25 are, therefore, preferably designed so that insertion of the shoulder stock 1, 1' is not prevented by the safety element 15.

To make it possible to remove the shoulder stock 1, 1' without any great effort despite the safety element 15, the safety element 15 can preferably be released manually by the marksman in such a way that the lock on the slide rail 3*b* is released. The shoulder stock 1, 1' can, thus, be removed easily by the marksman in case of need (e.g., if it interferes with the shooting process due to damage during battle). A tool is preferably needed to release the safety element 15 so as to prevent unintentional removal of the shoulder stock 1, 1'.

For a compact design of the gun, it is advantageous if the catch lever 11, 11', and optionally also the safety element 15, are accommodated in the interior of the gun casing. These are, therefore, preferably an integral part of the end plate 9 of the gun casing.

The statements made above regarding the shoulder stock 1, 1' also apply accordingly for the catch lever 11, 11' and its advantageous embodiments.

Although certain apparatus constructed in accordance with the teachings of the invention have been described herein, the scope of coverage of this patent is not limited thereto. On the contrary, this patent covers all embodiments of the teachings of the invention fairly failing within the scope of the appended claims either literally or under the doctrine of equivalents.

What is claimed is:

1. For use with a firearm having a casing, a retractable shoulder stock comprising:

a slide rail which is displaceable relative to the casing of the firearm, the slide rail defining at least one recess; and a catch lever which is mounted for rotation about a pivot axis, the pivot axis oriented generally parallel to a longitudinal axis of the slide rail, the catch lever having a peripheral surface that can be manually engaged to rotate the catch lever about the pivot axis, the catch lever being positioned to selectively engage in the at least one recess to releasably lock the slide rail in a first predetermined position.

2. A shoulder stock as defined in claim 1, further comprising a spring which biases the catch lever into contact with the slide rail such that the catch lever automatically engages in the at least one recess of the slide rail when the catch lever and recess are aligned.

3. A shoulder stock as defined in claim 1, wherein the at least one recess passes through the slide rail in a transverse direction.

4. A shoulder stock as defined in claim 1, wherein the peripheral surface of the catch lever extends beyond the at least one recess.

5. A shoulder stock as defined in claim 1, wherein the catch lever has a handle on the peripheral surface.

6. A shoulder stock as defined in claim 1, wherein the at least one recess comprises at least two recesses, the at least two recesses being located on the slide rail such that the shoulder stock can be secured in the first predetermined position and in a second predetermined position.

7. A shoulder stock as defined in claim 6, further comprising a spring positioned to exert a force on the shoulder stock when the shoulder stock is secured in the first predetermined position, the force tending to push the shoulder stock in the direction of the second predetermined position.

8. A shoulder stock as defined in claim 1, wherein the slide rail comprises a first slide rail, and further comprising a second slide rail, wherein the pivot axis of the catch lever is located between the first and second slide rails, and wherein the catch lever engages a top side of the first slide rail and a bottom side of the second slide rail.

9. A shoulder stock as defined in claim 8, wherein the at least one recess comprises a first recess located on the top side of the first rail and a second recess located on the bottom side of the second rail.

10. A shoulder stock as defined in claim 9, wherein the slide rails are under tension in a radial direction relative to the pivot axis when the catch lever engages in the first and second recesses.

11. A shoulder stock as defined in claim 1, further comprising a second recess defined in the slide rail and a spring-loaded safety element, the spring-loaded safety element being positioned to automatically engage in the second recess such that the shoulder stock is secured to prevent it from being pulled completely out of the casing.

12. A shoulder stock as defined in claim 11, wherein the second recess includes a camming surface such that the safety element does not prevent the shoulder stock from being pushed in relative to the casing.

13. A shoulder stock as defined in claim 11, wherein the safety element can be released manually to remove the shoulder stock from the casing.

14. A shoulder stock as defined in claim 11, wherein the safety element is mounted within an end plate of the casing.

15. A shoulder stock as defined in claim 1, wherein the catch lever is mounted within an end plate of the casing.

16. A firearm comprising:

a casing;

a retractable stock including a slide rail which is displaceable relative to the casing, the slide rail defining at least one recess; and a catch lever which is mounted for rotation about a pivot axis, the pivot axis oriented generally parallel to a longitudinal axis of the slide rail, the catch lever having a peripheral surface that can be manually engaged to rotate the catch lever about the pivot axis, the catch lever being positioned to selectively engage in the at least one recess to releasably lock the retractable stock in a first predetermined position.

17. A firearm as defined in claim 16 wherein the casing includes an end plate, and wherein the catch lever is mounted within the end plate.

18. A method of releasably securing a retractable stock of a firearm in a first predetermined position comprising:

pivoting a catch lever about a pivot axis to disengage the catch lever from a first recess defined in a slide rail associated with the retractable stock, the pivot axis disposed generally parallel to a longitudinal axis of the slide rail;

moving the slide rail; and pivoting the catch lever about the pivot axis to engage a second recess defined in the slide rail.

19. A method as defined in claim 18, wherein the pivoting of the catch lever to engage either of the first recess or the second recess defined in the slide rail is done automatically by a spring force.

20. For use with a firearm having a casing, a retractable shoulder stock comprising:

a pair of slide rails adapted to be slidably mounted to the casing of the firearm and adapted to receive the shoulder stock; and a catch lever mounted for rotation about a pivot axis, the pivot axis oriented generally parallel to a longitudinal axis of the slide rails, the catch lever having a manually engageable peripheral surface to permit rotation of the catch lever about the pivot axis, each of the slide rails including a structure sized and shaped to permit the catch lever to simultaneously engage both of the slide rails to thereby permit the slide rails to be selectively positioned relative to the firearm casing in at least one predetermined position.

21. A shoulder stock as defined in claim 20, wherein the pivot axis is disposed between the pair of slide rails.

22. A shoulder stock as defined in claim 20, and wherein the catch lever engages a top side of a first one of the slide rails and a bottom side of a second one of the slide rails.

23. A shoulder stock as defined in claim 20, including an end plate sized for mounting to the firearm casing, the end plate having a pair of spaced apart apertures sized to slidably receive the pair of side rails.

24. A shoulder stock as defined by claim 23, wherein the catch lever is mounted to the end plate.

25. A shoulder stock as defined by claim 23, wherein the end plate includes a recessed securing lever, the securing lever sized and shaped to engage a securing catch on at least one of the pair of side rails.

26. For use with a firearm having a casing, a retractable shoulder stock comprising:

a pair of slide rails adapted to be slidably mounted to the casing of the firearm and adapted to receive the shoulder stock; and a catch lever mounted for rotation about a pivot axis, the pivot axis oriented generally parallel to a longitudinal axis of the slide rails, the catch lever shiftable between a first position in which the catch lever engages both of the side rails to thereby fix the longitudinal position of the slide rails and a second position in which the longitudinal position of the slide rails is adjustable.

27. A shoulder stock as defined by claim 26, including an end plate sized for mounting to the firearm casing, the catch lever mounted to the end plate, the end plate having a pair of spaced apart apertures sized to slidably receive the pair of side rails, and wherein the catch lever includes a peripheral surface sized to protrude from the end plate to permit manual rotation of the catch lever about the pivot axis.

28. A shoulder stock as defined by claim 27, wherein the end plate includes a recessed safety catch, the safety catch shiftable between a first position in which the safety catch engages a predetermined portion of one of the side rails to prevent withdrawal of the side rails from the end plate, and a second position in which the safety catch permits withdrawal of the side rails from the end plate.

29. A shoulder stock as defined by claim 28, wherein the predetermined portion of the one side rail and the safety catch cooperate to move the safety catch toward the second position in response to inward movement of the side rails toward the end plate.

* * * * *